US010460662B2

(12) United States Patent
Song et al.

(10) Patent No.: US 10,460,662 B2
(45) Date of Patent: Oct. 29, 2019

(54) ELECTROLUMINESCENT DISPLAY AND METHOD OF SENSING ELECTRICAL CHARACTERISTICS OF ELECTROLUMINESCENT DISPLAY

(71) Applicant: LG Display Co., Ltd., Seoul (KR)

(72) Inventors: Eunji Song, Seoul (KR); Kiwon Son, Goyang-si (KR); Hunki Shin, Paju-si (KR); Dongik Kim, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 36 days.

(21) Appl. No.: 15/802,877

(22) Filed: Nov. 3, 2017

(65) Prior Publication Data

US 2018/0151112 A1 May 31, 2018

(30) Foreign Application Priority Data

Nov. 28, 2016 (KR) ..... 10-2016-0159578

(51) Int. Cl.

| | |
|---|---|
| ***G09G 3/32*** | (2016.01) |
| ***G09G 3/325*** | (2016.01) |
| ***G09G 3/00*** | (2006.01) |
| ***G09G 3/3258*** | (2016.01) |
| ***G09G 3/3283*** | (2016.01) |
| ***G09G 3/3291*** | (2016.01) |

(Continued)

(52) U.S. Cl.

CPC ..... *G09G 3/325* (2013.01); *G09G 3/006* (2013.01); *G09G 3/3233* (2013.01); *G09G 3/3258* (2013.01); *G09G 3/3283* (2013.01); *G09G 3/3291* (2013.01); *G09G 3/2096* (2013.01); *G09G 2300/0426* (2013.01); *G09G 2300/0842* (2013.01); *G09G 2310/0264* (2013.01); *G09G 2320/0295* (2013.01); *G09G 2320/045* (2013.01); *G09G 2370/08* (2013.01)

(58) Field of Classification Search

CPC ..... G09G 3/32–3291

See application file for complete search history.

(56) References Cited

U.S. PATENT DOCUMENTS 8,378,578 B2 * 2/2013 Kimura ..... G09G 3/3241 315/169.1

2004/0233141 A1 * 11/2004 Matsumoto ..... G09G 3/3266 345/76

(Continued)

OTHER PUBLICATIONS

Extended European Search Report dated May 15, 2018, issued in corresponding European Patent Application No. 17204173.3.

*Primary Examiner* — Lin Li

(74) *Attorney, Agent, or Firm* — Morgan, Lewis & Bockius LLP

(57) ABSTRACT

An electroluminescent display and a method of sensing electrical characteristics of the electroluminescent display are disclosed. The electroluminescent display includes a display panel including a plurality of pixels, a plurality of gate lines, and a plurality of data lines and a driver integrated circuit connected to the data line through a channel terminal. The driver integrated circuit includes a data voltage generator configured to generate a data voltage to be supplied to the pixel, a first switch connected between the channel terminal and the data voltage generator, a sensor configured to sense electrical characteristics of the pixel, and a second switch connected between the channel terminal and the sensor.

10 Claims, 17 Drawing Sheets

(51) Int. Cl.
*G09G 3/3233* (2016.01)
*G09G 3/20* (2006.01)

(56) References Cited

U.S. PATENT DOCUMENTS

2005/0110721 A1* 5/2005 Shin ..... G09G 3/325
345/76
2006/0139253 A1* 6/2006 Choi ..... G09G 3/3233
345/76
2006/0170625 A1* 8/2006 Kim ..... G09G 3/3225
345/76
2006/0232678 A1* 10/2006 Choi ..... G09G 3/3233
348/207.11
2008/0174574 A1* 7/2008 Yoo ..... G09G 3/3233
345/204
2008/0231562 A1* 9/2008 Kwon ..... G09G 3/3233
345/77
2009/0051628 A1* 2/2009 Kwon ..... G09G 3/3233
345/77
2011/0102410 A1 5/2011 Cho et al.
2013/0050292 A1* 2/2013 Mizukoshi ..... G09G 3/3291
345/690
2013/0083001 A1* 4/2013 Jeong ..... G09G 3/3233
345/212
2013/0147694 A1* 6/2013 Kim ..... G09G 3/32
345/82
2014/0084932 A1 3/2014 Chaji et al.
2014/0152705 A1* 6/2014 Kwon ..... G09G 3/3275
345/690
2015/0130785 A1* 5/2015 Shin ..... G09G 3/3233
345/213
2016/0203764 A1 7/2016 In et al.

* cited by examiner

ELECTROLUMINESCENT DISPLAY AND METHOD OF SENSING ELECTRICAL CHARACTERISTICS OF ELECTROLUMINESCENT DISPLAY

This application claims the benefit of Korea Patent Application No. 10-2016-0159578 filed on Nov. 28, 2016, which is incorporated herein by reference for all purposes as if fully set forth herein.

BACKGROUND

Technical Field

The present disclosure relates to an electroluminescent display and a method of sensing electrical characteristics of the electroluminescent display.

Discussion of the Related Art

Various types of panel displays have been developed and sold. Among the various types of flat panel displays, an electroluminescent display is classified into an inorganic electroluminescent display and an organic electroluminescent display depending on a material of an emission layer. In particular, an active matrix organic light emitting diode (OLED) display includes a plurality of OLEDs capable of emitting light by themselves and has many advantages, such as fast response time, high emission efficiency, high luminance, wide viewing angle, and the like.

An OLED serving as a self-emitting element includes an anode electrode, a cathode electrode, and an organic compound layer between the anode electrode and the cathode electrode. The organic compound layer includes a hole injection layer HIL, a hole transport layer HTL, an emission layer EML, an electron transport layer ETL, and an electron injection layer EIL. When a power voltage is applied to the anode electrode and the cathode electrode, holes passing through the hole transport layer HTL and electrons passing through the electron transport layer ETL move to the emission layer EML and form excitons. As a result, the emission layer EML generates visible light.

An OLED display includes a plurality of pixels, each including an OLED and a driving thin film transistor (TFT) that adjusts a luminance of an image implemented on the pixels based on a grayscale of image data. The driving TFT controls a driving current flowing in the OLED depending on a voltage between a gate electrode and a source electrode of the driving TFT. An amount of light emitted by the OLED is determined depending on the driving current of the OLED, and the luminance of the image is determined depending on the amount of light emitted by the OLED.

The OLED is degraded as an emission time of the OLED increases. When the OLED is degraded, a threshold voltage capable of turning on the OLED increases and the emission efficiency of the OLED is reduced. Because the accumulated emission time of the OLED may be different for each pixel, the degradation of the OLED may vary from pixel to pixel. A difference in degradation between the OLEDs of the pixels may lead to a luminance variation and may cause an image sticking phenomenon.

For this reason, a related art OLED display has adopted a degradation compensation technique that senses an threshold voltage of an OLED to determine degradation of the OLED and corrects image data with a compensation value capable of compensating for the degradation of the OLED. In order to sense the threshold voltage of the OLED, the related art OLED display embeds a plurality of sensing units in a data driver integrated circuit (IC) and connects the pixels to the sensing units through sensing lines.

The sensing lines are additionally provided for a display panel so as to sense the threshold voltage of the OLED, but are a major factor reducing a line design margin of the display panel. In order to reduce the number of sensing lines, a sharing structure, in which a plurality of horizontally adjacent pixels shares one sensing line, has been proposed. However, when the sensing line sharing structure is adopted, it is impossible to individually detect the shared pixels.

SUMMARY

Accordingly, embodiments of the present disclosure are directed to an electroluminescent display and a method of sensing electrical characteristics of the electroluminescent display that substantially obviates one or more of the problems due to limitations and disadvantages of the related art.

An aspect of the present disclosure is to provide an electroluminescent display and a method of sensing electrical characteristics of the electroluminescent display capable of sensing an threshold voltage of an organic light emitting diode (OLED) without reducing a line design margin of a display panel.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, an electroluminescent display including a display panel including a plurality of pixels, a plurality of gate lines, and a plurality of data lines, and a driver integrated circuit connected to the data line through a channel terminal, wherein the driver integrated circuit includes a data voltage generator configured to generate a data voltage to be supplied to the pixel, a first switch connected between the channel terminal and the data voltage generator, a sensor configured to sense electrical characteristics of the pixel, and a second switch connected between the channel terminal and the sensor.

In another aspect, a method of sensing electrical characteristics is provided for an electroluminescent display including a plurality of pixels each including a driving thin film transistor (TFT) including a control electrode connected to a first node, a first electrode connected to a high potential driving power, and a second electrode connected to a second node and an organic light emitting diode (OLED) connected between the second node and a low potential driving power. The method comprises, during a first programming period, applying a first data voltage to the first node and the second node through a data line to turn on the driving TFT; during a degradation tracking period following the first programming period, applying a driving current to the OLED from the driving TFT to set a voltage of the second node depending on a degradation of the OLED; during a second programming period following the degradation tracking period, applying a second data voltage higher than the first data voltage to the second node through the data line; and during a sensing period following the second programming period, reading out a change in the voltage of the second node, which increases depending on the driving current, through the data line.

In yet another aspect, a method of sensing electrical characteristics is provided for an electroluminescent display including a plurality of pixels each including a driving thin film transistor (TFT) including a control electrode connected to a first node, a first electrode connected to a high potential driving power, and a second electrode connected to a second node and an organic light emitting diode (OLED) connected between the second node and a low potential driving power. The method comprises, during an initialization period, applying a data voltage higher than an threshold voltage of the OLED to the second node through a data line to initialize the second node; and during a sensing period following the initialization period, reading out a change in a voltage of the second node, which decreases as the data voltage is discharged through the OLED, through the data line.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated and constitute a part of this application, illustrate embodiments of the disclosure and together with the description serve to explain various principles. In the drawings.

DETAILED DESCRIPTION

Figure 1:
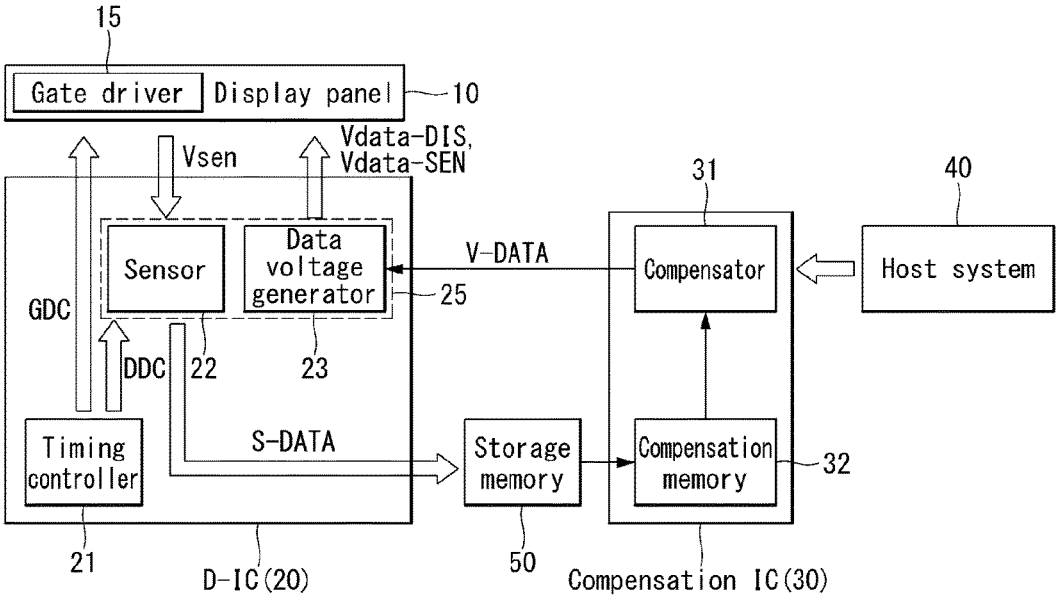
FIG. 1 is a block diagram of an electroluminescent display according to an example embodiment.

Reference will now be made in detail to embodiments of the present disclosure, examples of which are illustrated in the accompanying drawings. However, the present disclosure is not limited to embodiments disclosed below, and may be implemented in various forms. These embodiments are provided so that the present disclosure will be described more completely, and will fully convey the scope of the present disclosure to those skilled in the art to which the present disclosure pertains. Particular features of the present disclosure can be defined by the scope of the claims.

Shapes, sizes, ratios, angles, number, and the like illustrated in the drawings for describing embodiments of the present disclosure are merely exemplary, and the present disclosure is not limited thereto unless specified as such. Like reference numerals designate like elements throughout. In the following description, when a detailed description of certain functions or configurations related to this document that may unnecessarily cloud the gist of the present disclosure have been omitted.

In the present disclosure, when the terms "include", "have", "comprise", etc. are used, other components may be added unless "~only" is used. A singular expression can include a plural expression as long as it does not have an apparently different meaning in context.

In the explanation of components, even if there is no separate description, it is interpreted as including margins of error or an error range.

In the description of positional relationships, when a structure is described as being positioned "on or above", "under or below", "next to" another structure, this description should be construed as including a case in which the structures directly contact each other as well as a case in which a third structure is disposed therebetween.

The terms "first", "second", etc. may be used to describe various components, but the components are not limited by such terms. The terms are used only for the purpose of distinguishing one component from other components. For example, a first component may be designated as a second component, and vice versa, without departing from the scope of the present disclosure.

The features of various embodiments of the present disclosure can be partially combined or entirely combined with each other, and can be technically interlocking-driven in various ways. The embodiments can be independently implemented, or can be implemented in conjunction with each other.

Various embodiments of the present disclosure will be described in detail below with reference to the accompanying drawings. In the following embodiments, an electroluminescent display will be described focusing on an organic light emitting diode (OLED) display including an organic light emitting material. However, it should be noted that embodiments of the present disclosure are not limited to the OLED display, and may be applied to an inorganic light emitting display including an inorganic light emitting material.

Figure 2:
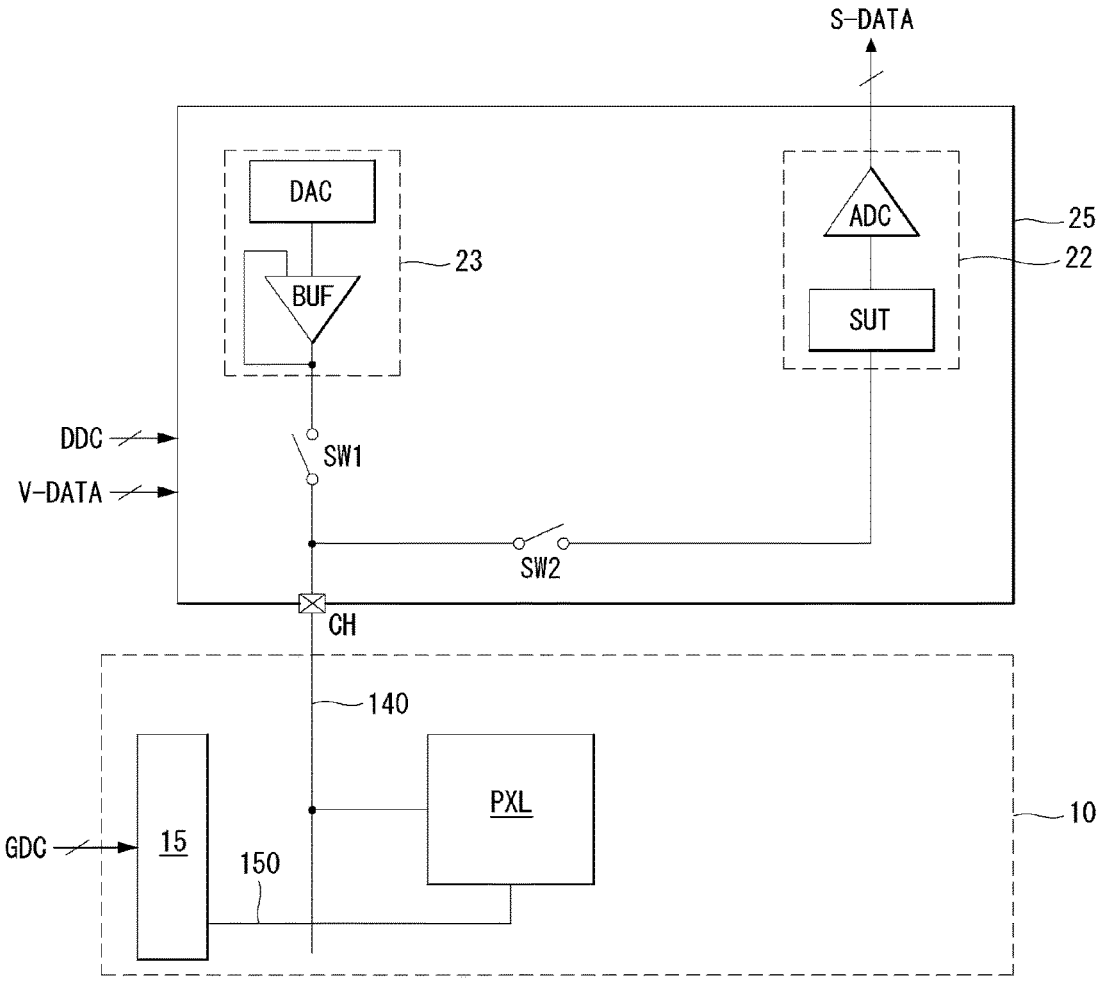
FIG. 2 schematically illustrates a connection configuration between a driver integrated circuit and a pixel in accordance with an example embodiment.
Figure 3:
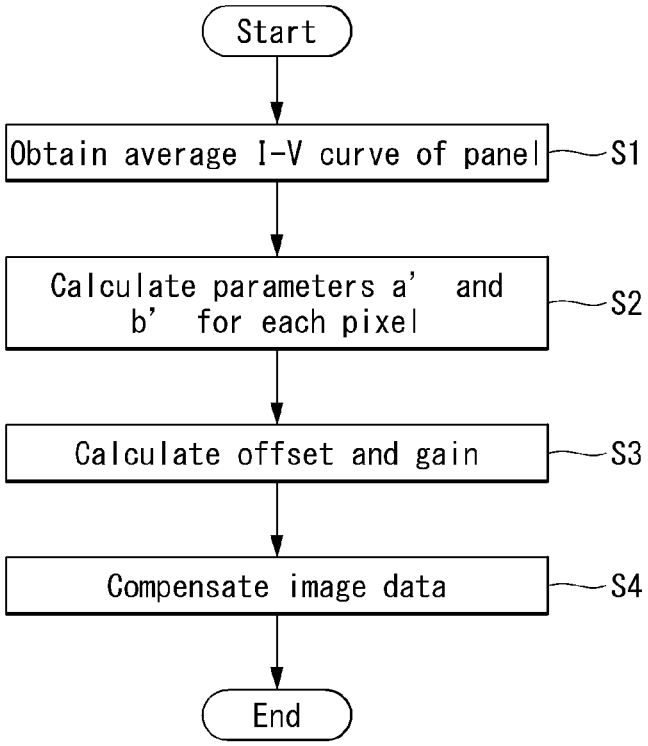
FIG. 3 is a flow chart illustrating an external compensation method according to an example embodiment.
Figure 4A:
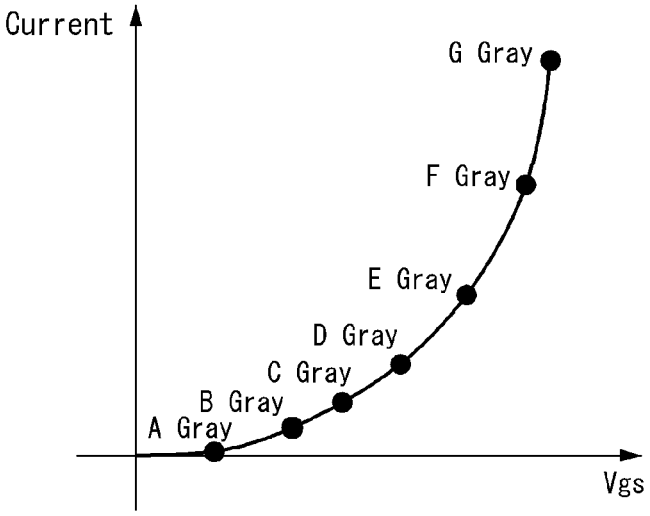
FIG. 4A illustrates that a reference curve equation is obtained in an external compensation method of FIG. 3.
Figure 4B:
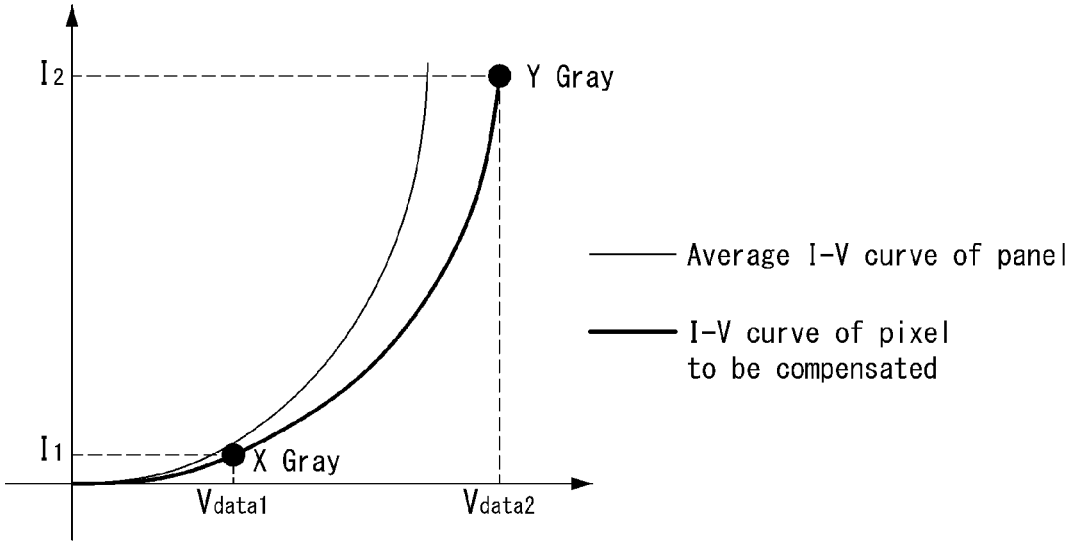
FIG. 4B illustrates an average I-V curve of a display panel and an I-V curve of a pixel to be compensated in an external compensation method of FIG. 3.
Figure 4C:
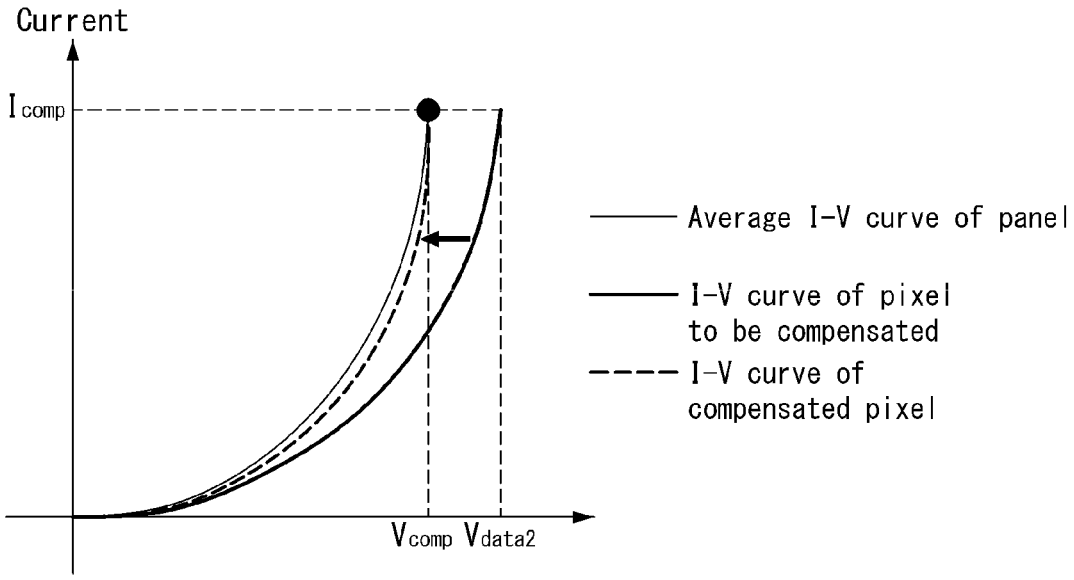
FIG. 4C illustrates an average I-V curve of a display panel, an I-V curve of a pixel to be compensated, and an I-V curve of a compensated pixel in an external compensation method of FIG. 3.

FIG. 1 is a block diagram of an electroluminescent display according to an example embodiment. FIG. 2 schematically illustrates a connection configuration between a driver integrated circuit (IC) and a pixel in accordance with an example embodiment. FIG. 3 is a flow chart illustrating an external compensation method according to an example embodiment. FIG. 4A illustrates that a reference curve equation is obtained in the external compensation method of FIG. 3. FIG. 4B illustrates an average I-V curve of a display panel and an I-V curve of a pixel to be compensated in the external compensation method of FIG. 3. FIG. 4C illustrates an average I-V curve of a display panel, an I-V curve of a pixel to be compensated, and an I-V curve of a compensated pixel in the external compensation method of FIG. 3.

Referring to FIGS. 1 and 2, an electroluminescent display according to an example embodiment may include a display panel 10, a driver IC (or referred to as "D-IC") 20, a compensation IC 30, a host system 40, and a storage memory 50.

The display panel 10 includes a plurality of pixels PXL and a plurality of signal lines. The signal lines may include data lines 140 for supplying data signals (e.g., analog data voltages) to the pixels PXL and gate lines 150 for supplying gate signals to the pixels PXL.

In embodiments disclosed herein, the gate signal may include a plurality of gate signals including a first gate signal SCAN1 and a second gate signal SCAN2. In this instance, each gate line 150 may include a first gate line 150A for supplying the first gate signal SCAN1 and a second gate line 150B for supplying the second gate signal SCAN2 (see FIG. 8). However, the gate signal may include one gate signal depending on a circuit configuration of the pixel PXL. In this instance, each gate line 150 may include one gate line. Embodiments are not limited to exemplary configurations of the gate signal and the gate line 150.

Electrical characteristics (e.g., a threshold voltage of an organic light emitting diode (OLED)) of the pixel PXL may be sensed through not a separate sensing line but the data line 140. When the electrical characteristics of the pixel PXL are sensed using the data line 140 as described above, embodiments can sense the threshold voltage of the OLED without reducing a line design margin of the display panel 10.

The pixels PXL of the display panel 10 are disposed in a matrix to form a pixel array. Each pixel PXL may be connected to one of the data lines 140 and at least one of the gate lines 150. Each pixel PXL is configured to receive a high potential driving power VDD and a low potential driving power VSS from a power generator (see FIG. 8). To this end, the power generator may supply the high potential driving power VDD to the pixel PXL through a high potential pixel power line or a pad and may supply the low potential driving power VSS to the pixel PXL through a low potential pixel power line or a pad.

Figure 8:
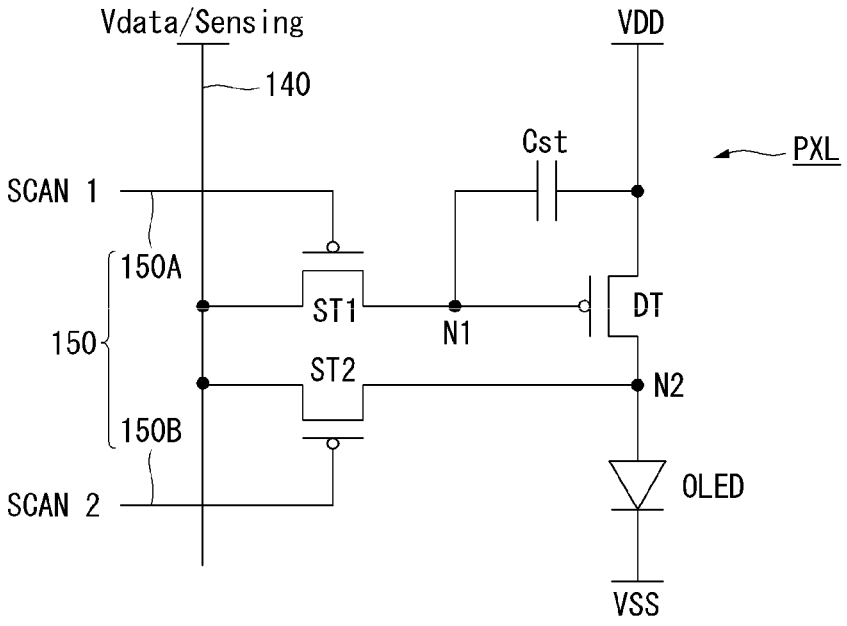
FIG. 8 is an equivalent circuit diagram of a pixel according to an example embodiment.

The gate driver 15 may generate a display gate signal necessary for a display drive operation and a sensing gate signal necessary for a sensing drive operation. Referring to FIG. 8, each of the display gate signal and the sensing gate signal may include a first gate signal SCAN1 and a second gate signal SCAN2.

In the display drive operation, the gate driver 15 may generate a first display gate signal SCAN1 to supply the first display gate signal SCAN1 to the first gate line 150A, and may generate a second display gate signal SCAN2 to supply the second display gate signal SCAN2 to the second gate line 150B. The first display gate signal SCAN1 and the second display gate signal SCAN2 are signals synchronized with an application timing of a display data voltage Vdata-DIS.

In the sensing drive operation, the gate driver 15 may generate a first sensing gate signal SCAN1 to supply the first sensing gate signal SCAN1 to the first gate line 150A, and may generate a second sensing gate signal SCAN2 to supply the second sensing gate signal SCAN2 to the second gate line 150B.

The gate driver 15 may be directly formed on a lower substrate of the display panel 10 in a gate driver-in panel (GIP) manner. The gate driver 15 may be formed in a non-display area (i.e., a bezel area) outside the pixel array of the display panel 10 through the same TFT process as the pixel array.

The driver IC 20 is connected to the data line 140 of the display panel 10 through a channel terminal CH. The driver IC 20 may include a timing controller 21 and a data driver 25.

The timing controller 21 may generate a gate timing control signal GDC for controlling operation timing of the gate driver 15 and a data timing control signal DDC for controlling operation timing of the data driver 25 based on timing signals, for example, a vertical sync signal Vsync, a horizontal sync signal Hsync, a dot clock signal DCLK, and a data enable signal DE received from the host system 40.

The data timing control signal DDC may include a source start pulse, a source sampling clock, and a source output enable signal, and the like, but is not limited thereto. The source start pulse controls start timing of data sampling of the data driver 25. The source sampling clock is a clock signal that controls sampling timing of data based on a rising edge or a falling edge thereof. The source output enable signal controls output timing of the data driver 25.

The gate timing control signal GDC may include a gate start pulse, a gate shift clock, and the like, but is not limited thereto. The gate start pulse is applied to a stage of the gate driver 15 for generating a first output and activates an operation of the stage. The gate shift clock is a clock signal that is commonly input to stages and shifts the gate start pulse.

The timing controller 21 may control a sensing mode for the sensing drive operation and a display mode for the display drive operation in accordance with to a predetermined control sequence.

In the sensing mode, digital sensing data S-DATA indicating the electrical characteristics of the pixel PXL is obtained. In the display mode, input image data to be written to the pixels PXL is corrected based on the digital sensing data S-DATA obtained in the sensing mode, the corrected image data is converted into a display data voltage Vdata-DIS, and the display data voltage Vdata-DIS is applied to the pixels PXL.

The timing controller 21 may differently generate timing control signals for the display drive operation and timing control signals for the sensing drive operation. However, embodiments are not limited thereto. The sensing drive operation may be performed in a vertical blanking interval during the display drive operation, in a power-on sequence interval before the beginning of the display drive operation, or in a power-off sequence interval after the end of the display drive operation under the control of the timing controller 21. However, embodiments are not limited thereto. For example, the sensing drive operation may be performed in a vertical active period during the display drive operation.

The vertical blanking interval is time, for which input image data is not written, and is arranged between vertical active periods in which input image data corresponding to one frame is written. The power-on sequence interval is a transient time between the turn-on of driving power and the beginning of image display. The power-off sequence interval is a transient time between the end of image display and the turn-off of driving power.

The timing controller 21 may control all of operations for the sensing drive operation in accordance with a predetermined sensing process. Namely, the sensing drive operation may be performed in a state (for example, a standby mode, a sleep mode, a low power mode, etc.) where only a screen of the display device is turned off while the system power is being applied. However, embodiments are not limited thereto.

The data driver 25 includes a sensor 22, a data voltage generator 23, a first switch SW1, and a second switch SW2.

The data voltage generator 23 may include a digital-to-analog converter (DAC) converting a digital signal into an analog signal and an output buffer (not shown). The DAC generates the display data voltage Vdata-DIS or a sensing data voltage Vdata-SEN.

In the display drive operation, the data voltage generator 23 converts corrected image data V-DATA into an analog gamma voltage using the DAC and supplies the data lines 140 with a conversion result as the display data voltage Vdata-DIS through the first switch SW1. In the display drive operation, the display data voltage Vdata-DIS supplied to the data lines 140 is applied to the pixels PXL in synchronization with turn-on timing of the display gate signal. A gate-to-source voltage of a driving thin film transistor (TFT) included in the pixel PXL is programmed by the display data voltage Vdata-DIS, and a driving current flowing in the driving TFT is determined depending on the gate-to-source voltage of the driving TFT.

In the sensing drive operation, the data voltage generator 23 generates the previously set sensing data voltage Vdata-SEN using the DAC and then supplies the sensing data voltage Vdata-SEN to the data lines 140 through the first switch SW1. In the sensing drive operation, the sensing data voltage Vdata-SEN supplied to the data lines 140 is applied to the pixels PXL in synchronization with turn-on timing of the sensing gate signal. The gate-to-source voltage of the driving TFT included in the pixel PXL is programmed by the sensing data voltage Vdata-SEN, and a driving current flowing in the driving TFT is determined depending on the gate-to-source voltage of the driving TFT.

In the sensing drive operation, the sensor 22 may receive and sense the electrical characteristics Vsen of the pixel PXL, for example, the threshold voltage of the OLED included in the pixel PXL through the data line 140 and the second switch SW2. As shown in FIG. 2, the sensor 22 may include a sensing unit SUT and an analog-to-digital converter (ADC).

The sensing unit SUT may be implemented as a voltage sensing unit including a sample and hold unit. In the sensing drive operation, the sensing unit SUT samples a voltage charged to the data line 14 and supplies a result of sampling to the ADC.

In the sensing drive operation, the ADC converts an analog sampling signal received from the sensing unit SUT into a digital signal and outputs digital sensing data S-DATA indicating the electrical characteristics of the pixel PXL.

The ADC may be implemented as a flash ADC, an ADC using a tracking method, a successive approximation register ADC, and the like. The ADC supplies the digital sensing data S-DATA obtained in the sensing drive operation to the storage memory 50.

The first switch SW1 and the second switch SW2 may be differently turned on and off in the display drive operation and the sensing drive operation. The first switch SW1 is connected between the channel terminal CH and the data voltage generator 23, and the second switch SW2 is connected between the channel terminal CH and the sensor 22.

The storage memory 50 stores the digital sensing data S-DATA. The storage memory 50 may be implemented as a flash memory, but is not limited thereto.

In order to perform the display drive operation, the compensation IC 30 calculates an offset and a gain for each pixel based on the digital sensing data S-DATA read from the storage memory 50. The compensation IC 30 modulates (or corrects) digital image data to be input to the pixels PXL depending on the calculated offset and gain, and supplies the modulated digital image data V-DATA to the driver IC 20. To this end, the compensation IC 30 may include a compensator 31 and a compensation memory 32.

The compensation memory 32 allows access to the digital sensing data S-DATA read from the storage memory 50 to the compensator 31. The compensation memory 32 may be a random access memory (RAM), for example, a double data rate synchronous dynamic RAM (DDR SDRAM), but is not limited thereto.

As shown in FIGS. 3 to 4C, the compensator 31 may include a compensation algorithm that performs a compensation operation so that a current (I)-voltage (V) curve of a corresponding pixel to be compensated coincides with an average I-V curve. The average I-V curve may be obtained through a plurality of sensing operations.

More specifically, as shown in FIGS. 3 and 4A, the compensator 31 performs the sensing of a plurality of gray levels (for example, a total of seven gray levels A to G) and then obtains the following Equation 1 corresponding to the average I-V curve through a known least square method in step S1.

$$I=a(V_{data}-b)^c \qquad \text{[Equation 1]}$$

In the above Equation 1, "a" is electron mobility of the driving TFT, "b" is a threshold voltage of the driving TFT, and "c" is a physical property value of the driving TFT. "a" and "b" are characteristic values varying over the time, and "c" is a characteristic value independent of time.

As shown in FIGS. 3 and 4B, the compensator 31 calculates parameter values a' and b' of the corresponding pixel based on current values I1 and I2 and gray values (gray levels X and Y) (i.e., data voltage values Vdata1 and Vdata2 of digital level) measured at two points in step S2.

$$I_1=a'(V_{data1}-b')^c$$

$$I_2=a'(V_{data2}-b')^c \qquad \text{[Equation 2]}$$

The compensator 31 may calculate the parameter values a' and b' of the corresponding pixel using a quadratic equation in the above Equation 2.

As shown in FIGS. 3 and 4C, the compensator 31 may calculate an offset and a gain for causing the I-V curve of the corresponding pixel to be compensated to coincide with the average I-V curve in step S3. The offset and the gain of the compensated pixel are expressed by Equation 3.

[Equation 3]

$$Vcomp = \boxed{\text{Gain}\ \left(\frac{a}{a'}\right)^{\frac{1}{c}}} \times V_{data} + \boxed{\text{Offset}\ \left(b' - b\left(\frac{a}{a'}\right)^{\frac{1}{c}}\right)}$$

where "Vcomp" is a compensation voltage.

The compensator 31 corrects digital image data to be input to the corresponding pixel so that the digital image data corresponds to the compensation voltage Vcomp, in step S4. Icomp indicates the compensation current.

The host system 40 may supply digital image data to be input to the pixels PXL of the display panel 10 to the compensation IC 30. The host system 40 may further supply user input information, for example, digital brightness information to the compensation IC 30. The host system 40 may be implemented as an application processor.

Figure 5:
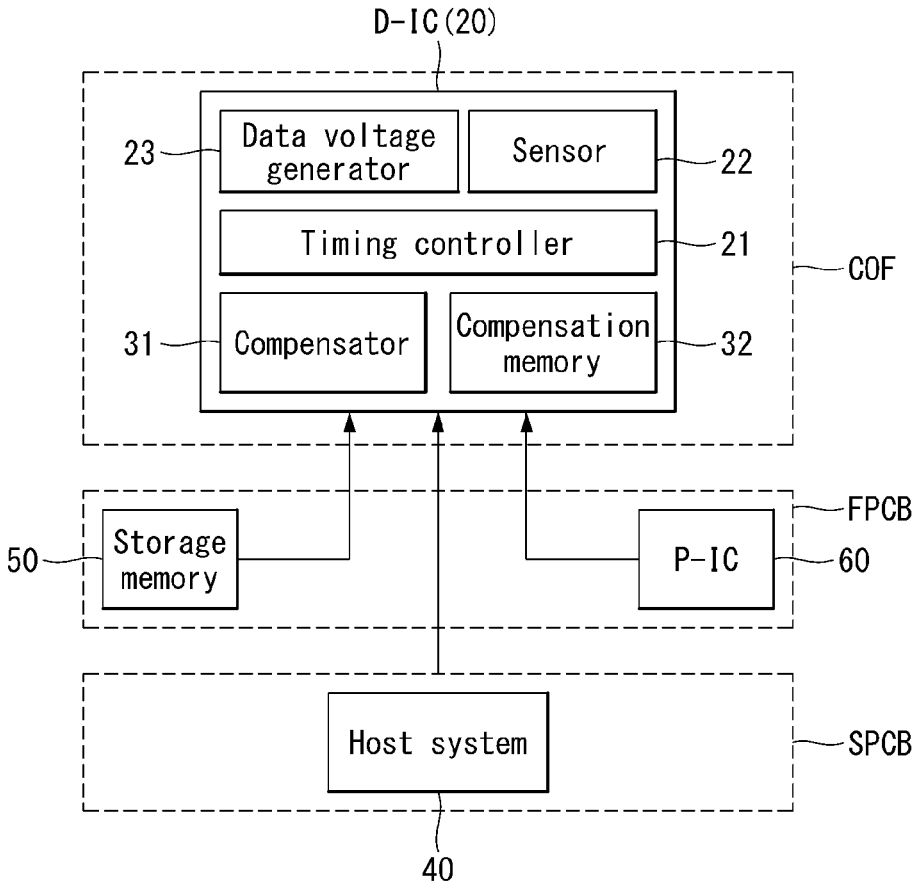
FIGS. 5 to 7 illustrate various examples of an external compensation module.
Figure 6:
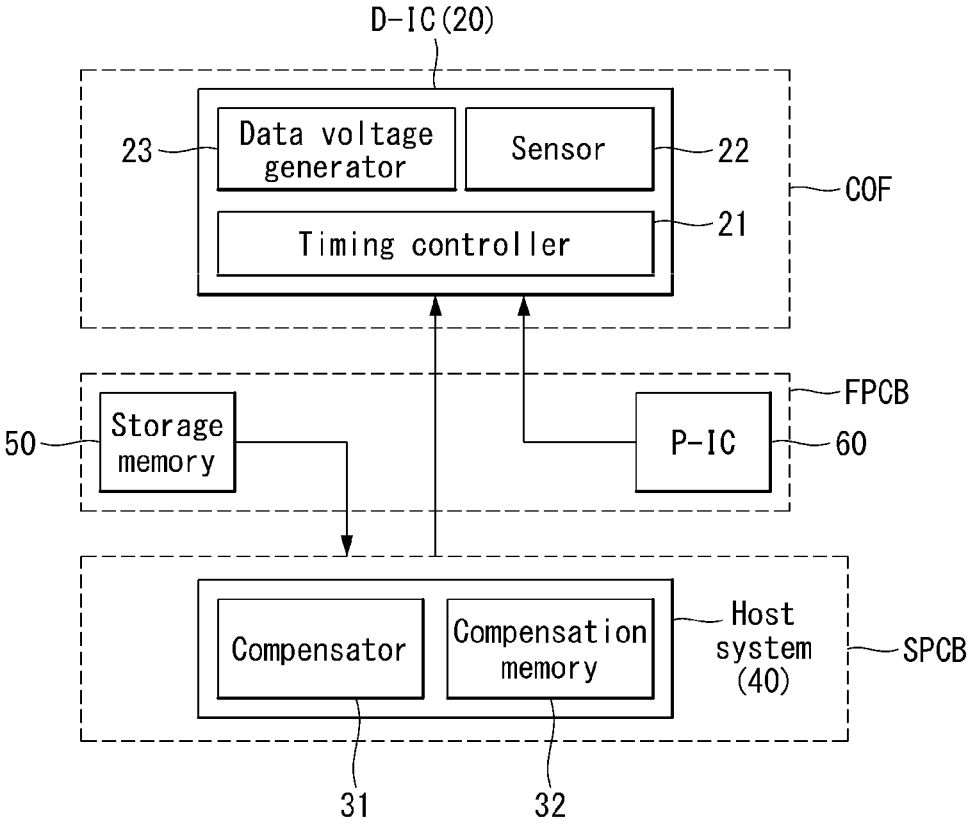
Figure 7:
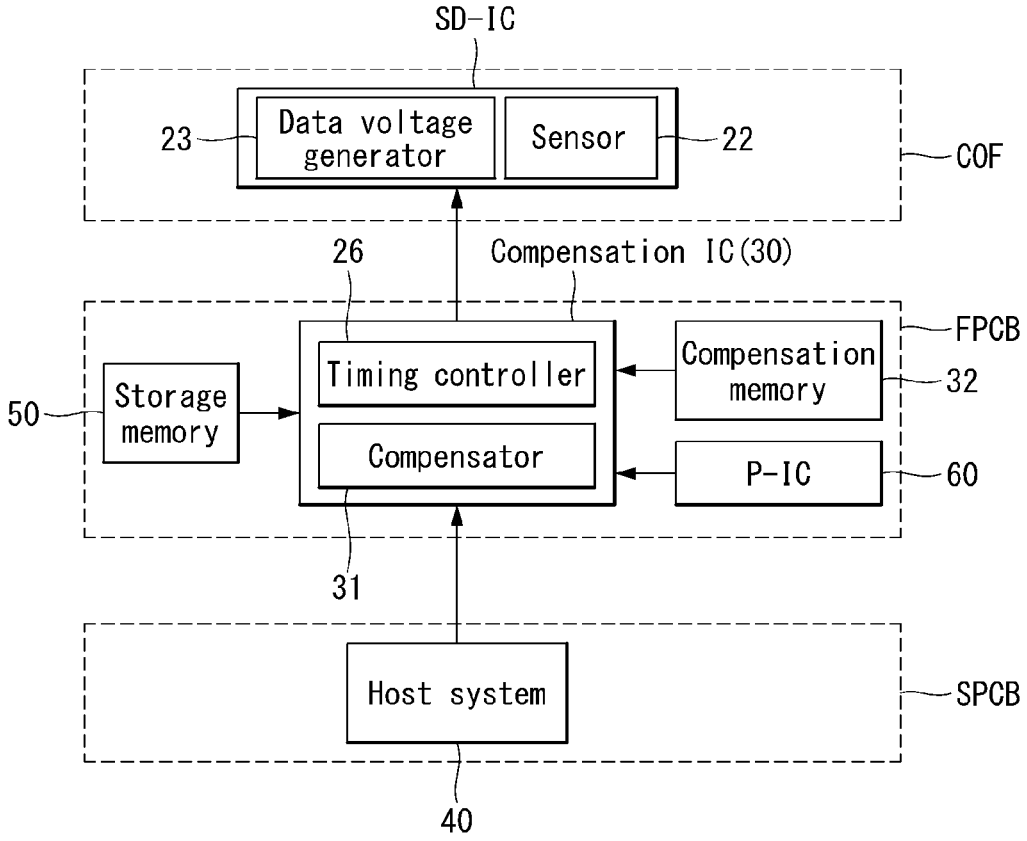

FIGS. 5 to 7 illustrate various examples of an external compensation module.

Referring to FIG. 5, the electroluminescent display according to the embodiment may include a driver IC (or referred to as "D-IC") 20 mounted on a chip-on film (COF), a storage memory 50 and a power IC (or referred to as "P-IC") 60 mounted on a flexible printed circuit board (FPCB), and a host system 40 mounted on a system printed circuit board (SPCB), in order to implement an external compensation module.

The driver IC (D-IC) 20 may further include a compensator 31 and a compensation memory 32 in addition to a timing controller 21, a sensor 22, and a data voltage generator 23. The external compensation module is implemented by forming the driver IC (D-IC) 20 and a compensation IC 30 (see FIG. 1) into one chip. The power IC (P-IC) 60 generates various driving powers required to operate the external compensation module.

Referring to FIG. 6, the electroluminescent display according to the embodiment may include a driver IC (or referred to as "D-IC") 20 mounted on a chip-on film (COF), a storage memory 50 and a power IC (or referred to as "P-IC") 60 mounted on a flexible printed circuit board (FPCB), and a host system 40 mounted on a system printed circuit board (SPCB), in order to implement an external compensation module.

The external compensation module of FIG. 6 is different from the external compensation module of FIG. 5 in that a compensator 31 and a compensation memory 32 are mounted on the host system 40 without being mounted on the driver IC 20. The external compensation module of FIG. 6 is implemented by integrating a compensation IC 30 (see FIG. 1) into the host system 40 and is meaningful in that the configuration of the driver IC 20 can be simplified.

Referring to FIG. 7, the electroluminescent display according to the embodiment may include a driver IC (or referred to as "D-IC") 20 mounted on a chip-on film (COF), a storage memory 50, a compensation IC 30, a compensation memory 32, and a power IC (or referred to as "P-IC") 60 mounted on a flexible printed circuit board (FPCB), and a host system 40 mounted on a system printed circuit board (SPCB), in order to implement an external compensation module.

The external compensation module of FIG. 7 is different from the external compensation modules of FIGS. 5 and 6 in that the configuration of the driver IC 20 is further simplified by mounting only a data voltage generator 23 and a sensor 22 in the driver IC 20, and a timing controller 21 and the compensator 31 are mounted in the compensation IC 30 that is separately manufactured. The external compensation module of FIG. 7 can easily perform an uploading and downloading operation of a compensation parameter by together mounting the compensation IC 30, the storage memory 50, and the compensation memory 32 on the flexible printed circuit board.

FIG. 8 is an equivalent circuit diagram of a pixel according to an example embodiment.

Referring to FIG. 8, each pixel PXL may include an OLED, a driving TFT DT, a storage capacitor Cst, a first switching TFT ST1, and a second switching TFT ST2. The TFTs constituting the pixel PXL may be implemented as p-type metal-oxide semiconductor (PMOS) transistors.

In FIG. 8, a first gate signal SCAN1 may be a first sensing gate signal, and a second gate signal SCAN2 may be a second sensing gate signal. A data voltage Vdata supplied to the data line 140 by the data voltage generator 23 may be a sensing data voltage Vdata-SEN.

The OLED is a light emitting element that emits light with a driving current input from the driving TFT DT. The OLED includes an anode electrode, a cathode electrode, and an organic compound layer between the anode electrode and the cathode electrode. The anode electrode is connected to a second node N2 that is a drain electrode of the driving TFT DT. The cathode electrode is connected to an input terminal of a low potential driving power VSS. A gray level of an image displayed on a corresponding pixel PXL is determined depending on an amount of light emitted by the OLED.

The driving TFT DT is a driving element controlling a driving current input to the OLED depending on a gate-to-source voltage Vgs of the driving TFT DT. The driving TFT DT includes a gate electrode (or referred to as "control electrode") connected to a first node N1, a source electrode (or referred to as "first electrode") connected to an input terminal of a high potential driving power VDD, and the drain electrode (or referred to as "second electrode") connected to the second node N2. The gate-to-source voltage Vgs of the driving TFT DT is a difference between a voltage of the high potential driving power VDD and a voltage of the first node N1.

The storage capacitor Cst is connected between the high potential driving power VDD and the first node N1. The storage capacitor Cst holds the gate-to-source voltage Vgs of the driving TFT DT for a particular time.

The first switching TFT ST1 applies the data voltage Vdata on the data line 140 to the first node N1 in response to the first gate signal SCAN1. The first switching TFT ST1 includes a gate electrode (or referred to as "control electrode") connected to the first gate line 150A, a source electrode (or referred to as "first electrode") connected to the data line 140, and a drain electrode (or referred to as "second electrode") connected to the first node N1.

The second switching TFT ST2 switches on and off a current flow between the second node N2 and the data line 140 in response to the second gate signal SCAN2. The second switching TFT ST2 includes a gate electrode (or referred to as "control electrode") connected to the second gate line 150B, a drain electrode (or referred to as "first electrode") connected to the data line 140, and a source electrode (or referred to as "second electrode") connected to the second node N2. When the second switching TFT ST2 is turned on, the second node N2 and the sensor 22 are electrically connected.

Figure 9:
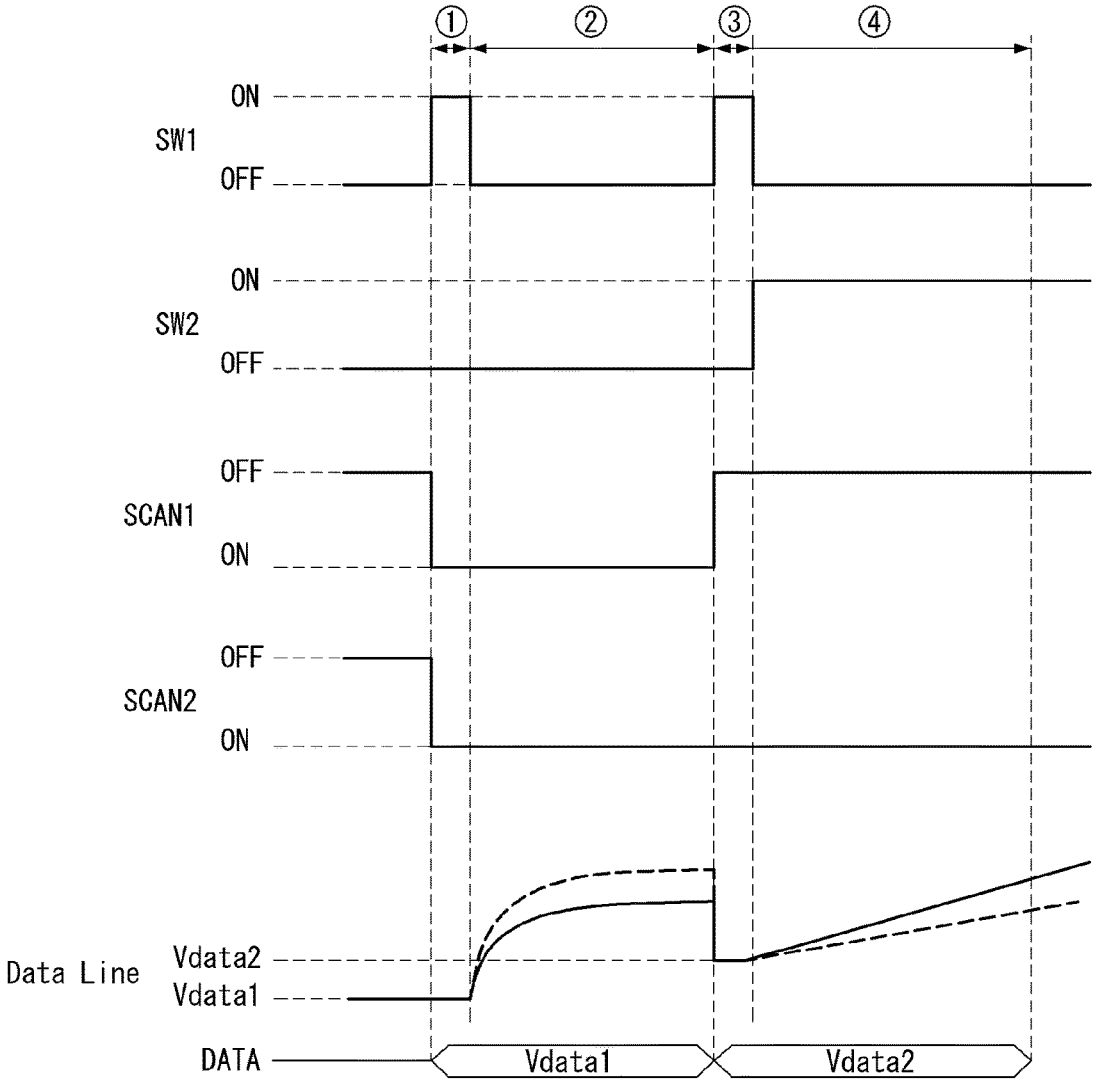
FIG. 9 is a driving waveform diagram for sensing electrical characteristics of an electroluminescent display according to an example embodiment.
Figure 10A:
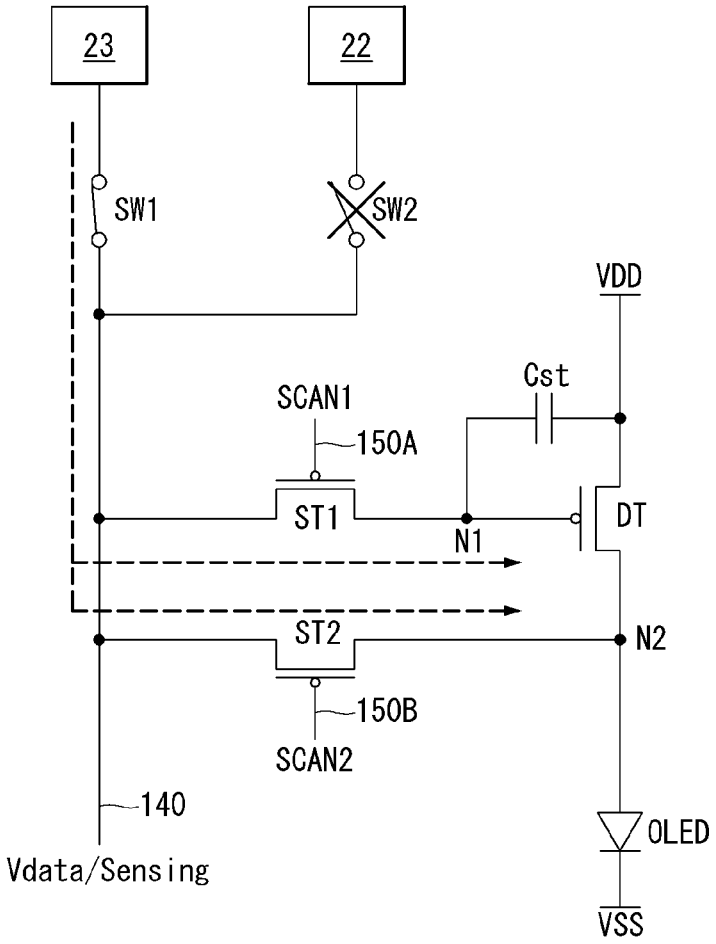
FIG. 10A is an equivalent circuit diagram of first and second switches and a pixel during a first programming period shown in FIG. 9.
Figure 10B:
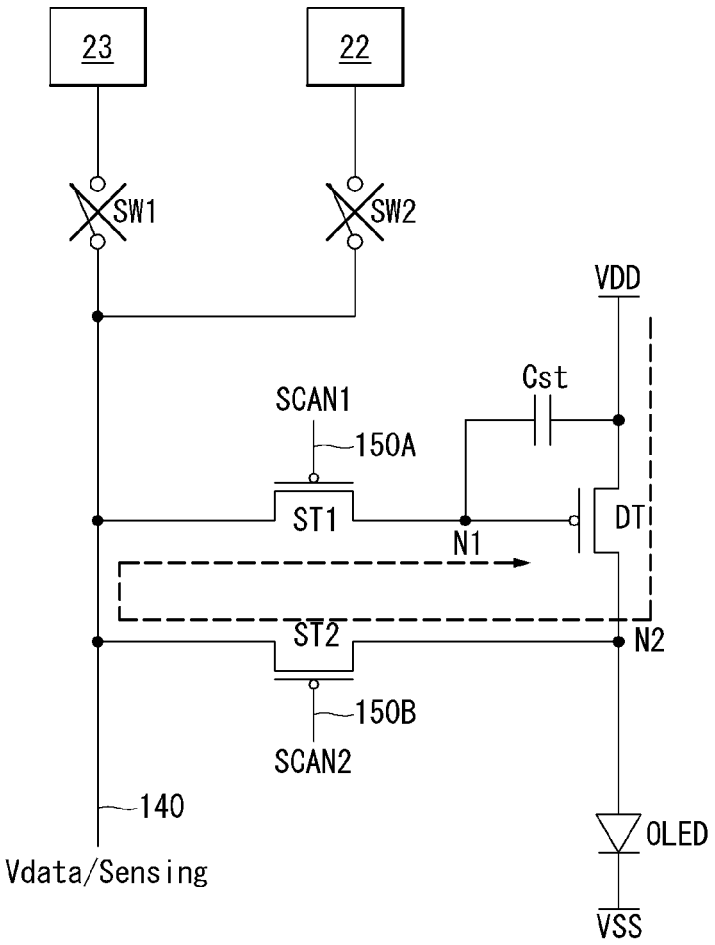
FIG. 10B is an equivalent circuit diagram of first and second switches and a pixel during a degradation tracking period shown in FIG. 9.
Figure 10C:
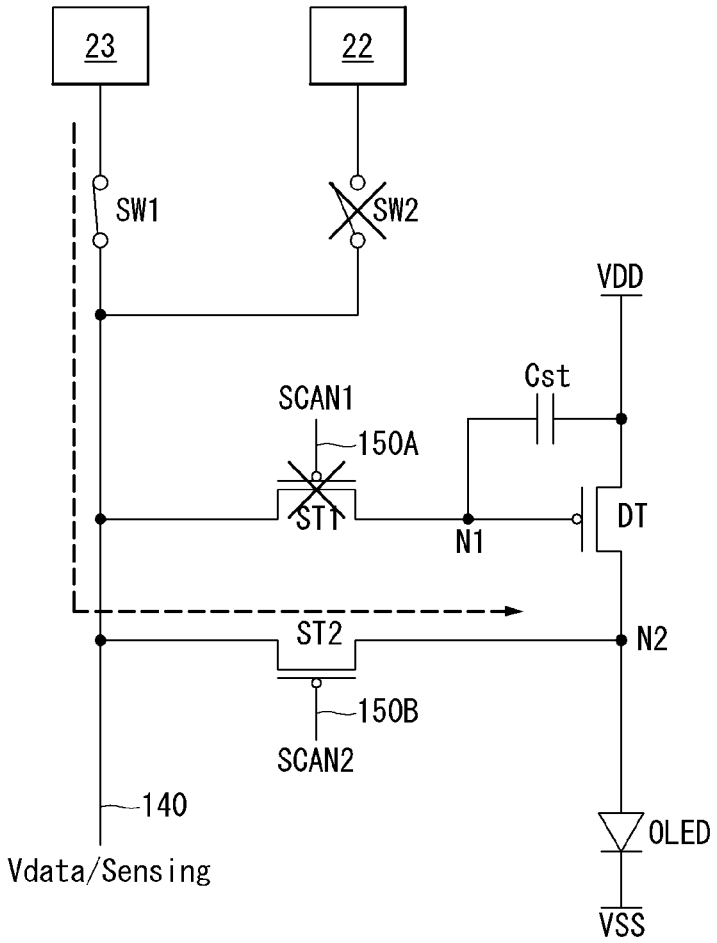
FIG. 10C is an equivalent circuit diagram of first and second switches and a pixel during a second programming period shown in FIG. 9.
Figure 10D:
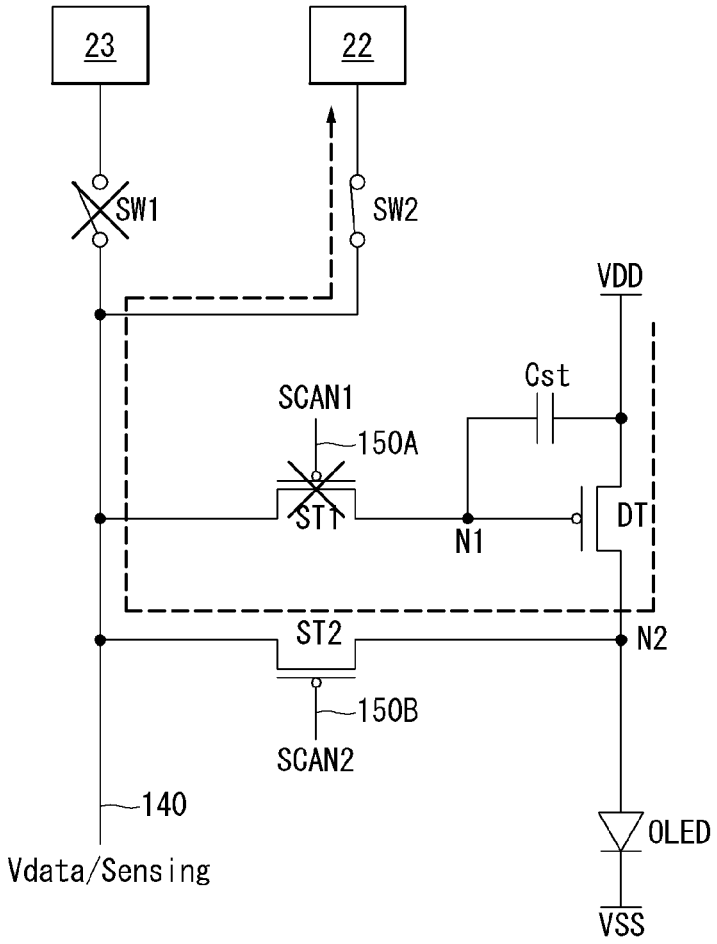
FIG. 10D is an equivalent circuit diagram of first and second switches and a pixel during a sensing period shown in FIG. 9.

FIG. 9 is a driving waveform diagram for sensing electrical characteristics of an electroluminescent display according to an example embodiment. FIG. 10A is an equivalent circuit diagram of first and second switches and a pixel during a first programming period shown in FIG. 9. FIG. 10B is an equivalent circuit diagram of first and second switches and a pixel during a degradation tracking period shown in FIG. 9. FIG. 10C is an equivalent circuit diagram of first and second switches and a pixel during a second programming period shown in FIG. 9. FIG. 10D is an equivalent circuit diagram of first and second switches and a pixel during a sensing period shown in FIG. 9.

With reference to FIG. 9, a sensing drive operation according to an example embodiment may be implemented through a first programming period ①, a degradation tracking period ②, a second programming period ③, and a sensing period ④ that are successively arranged. In FIG. 9, first and second data voltages Vdata1 and Vdata2 are sensing data voltages.

With reference to FIGS. 9 and 10A, during the first programming period ①, the second switch SW2 is turned off (OFF), and the first switch SW1, the first switching TFT ST1, and the second switching TFT ST2 are turned on (ON). Thus, during the first programming period ①, the first data voltage Vdata1 generated in the data voltage generator 23 is applied to the first node N1 through the first switch SW1 and the first switching TFT ST1, and the first data voltage Vdata1 is applied to the second node N2 through the first switch SW1 and the second switching TFT ST2. Because a difference between a voltage of the high potential driving power VDD and the first data voltage Vdata1 is greater than a threshold voltage of the driving TFT DT in the first programming period ①, the driving TFT DT satisfies turn-on condition in the first programming period ①. Further, the anode electrode of the OLED is initialized to the first data voltage Vdata1.

With reference to FIGS. 9 and 10B, during the degradation tracking period ②, the first and second switches SW1 and SW2 are turned off, and the first and second switching TFTs ST1 and ST2 are turned on. Thus, during the degradation tracking period ②, a voltage of the first node N1 and a voltage of the second node N2 increase up to a threshold voltage of the OLED by a current flowing in the driving TFT DT. In the degradation tracking period ②, the voltage of the second node N2 increases in proportion to (in direct proportion to) the degradation of the OLED. In this instance, because the data line 140 is connected to the second node N2, a voltage of the data line 140 increases in proportion to the degradation of the OLED during the degradation tracking period ②.

With reference to FIGS. 9 and 10C, during the second programming period ③, the first switch SW1 and the second switching TFT ST2 are turned on, and the second switch SW2 and the first switching TFT ST1 are turned off. Thus, during the second programming period ③, the second data voltage Vdata2 generated in the data voltage generator 23 is applied to the second node N2 through the first switch SW1 and the second switching TFT ST2. The second data voltage Vdata2 is greater than the first data voltage Vdata1 and is less than the threshold voltage of the OLED. When the second data voltage Vdata2 is less than the threshold voltage of the OLED as described above, it is easy to match voltage levels of analog sensing data with an input range of the ADC.

With reference to FIGS. 9 and 10D, during the sensing period ①, the second switch SW2 and the second switching TFT ST2 are turned on, and the first switch SW1 and the first switching TFT ST1 are turned off. Thus, even during the sensing period ④, the current flows in the driving TFT DT by the gate-to-source voltage stored in the storage capacitor Cst, and as a result, the voltage of the second node N2 and the voltage of the data line 140 connected to the second node N2 increase. During the sensing period ④, a change in the voltage of the second node N2, which decreases depending on the driving current, through the data line 140 is read out, and a rising slope of the voltage of the data line 140 is less after the degradation of the OLED than before the degradation of the OLED. As the degradation of the OLED proceeds, the threshold voltage of the OLED increases. Therefore, relatively more charges are accumulated on the anode electrode of the OLED than before the degradation of the OLED. Hence, a charging rate of the data line is reduced. As a result, the voltage of the data line 140 increases more slowly after the degradation of the OLED than before the degradation of the OLED.

As described above, in the sensing drive operation according to the embodiment, it is possible to sense the degradation of the OLED even in a PMOS pixel structure. Furthermore, because the threshold voltage of the OLED is sensed through the data line instead of the sensing line of the sharing structure, the OLED can be directly sensed.

Figure 11:
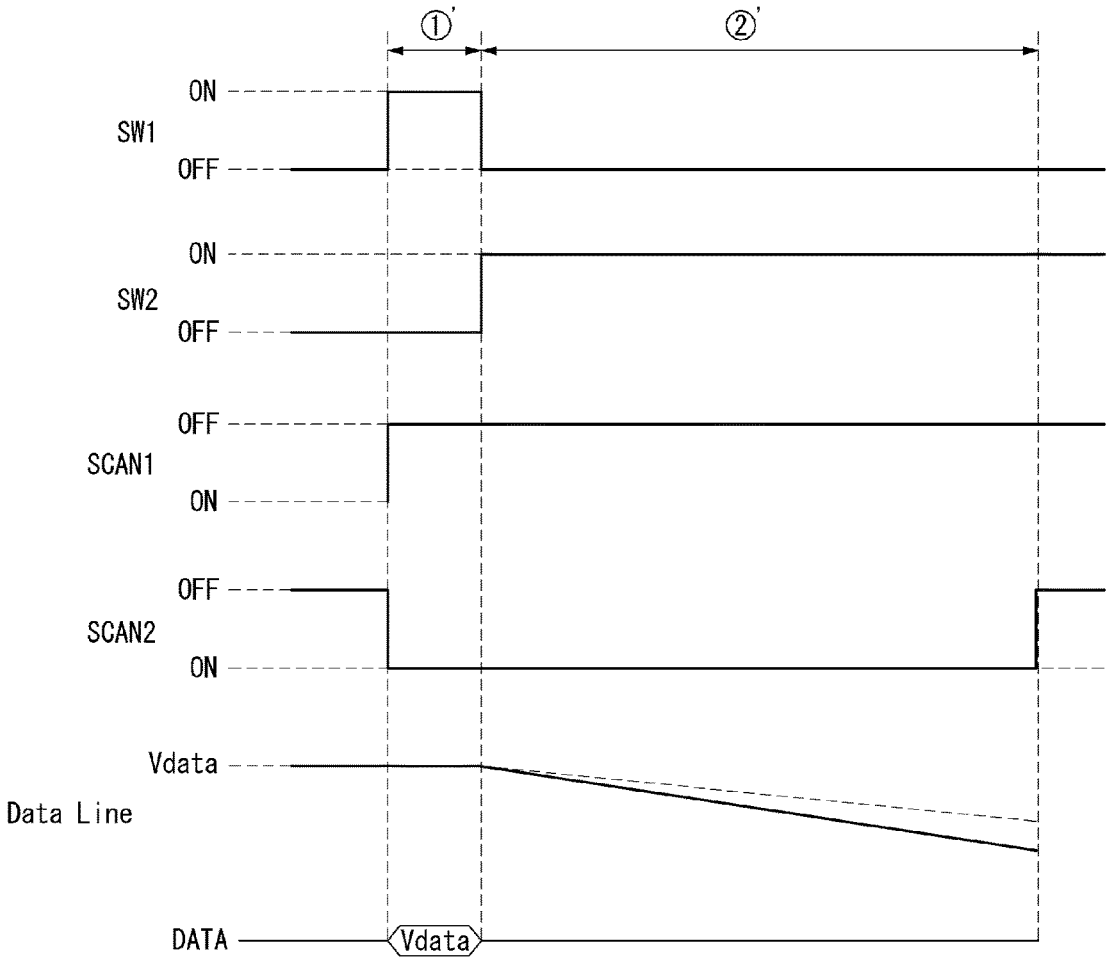
FIG. 11 is a driving waveform diagram for sensing electrical characteristics of an electroluminescent display according to another example embodiment.
Figure 12A:
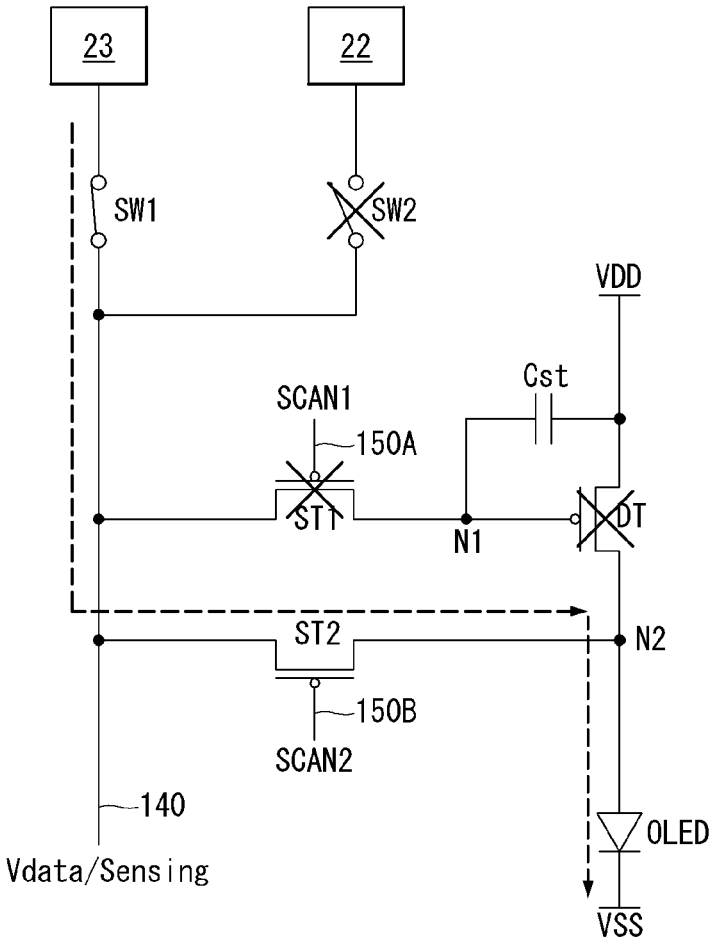
FIG. 12A is an equivalent circuit diagram of first and second switches and a pixel during an initialization period shown in FIG. 11.
Figure 12B:
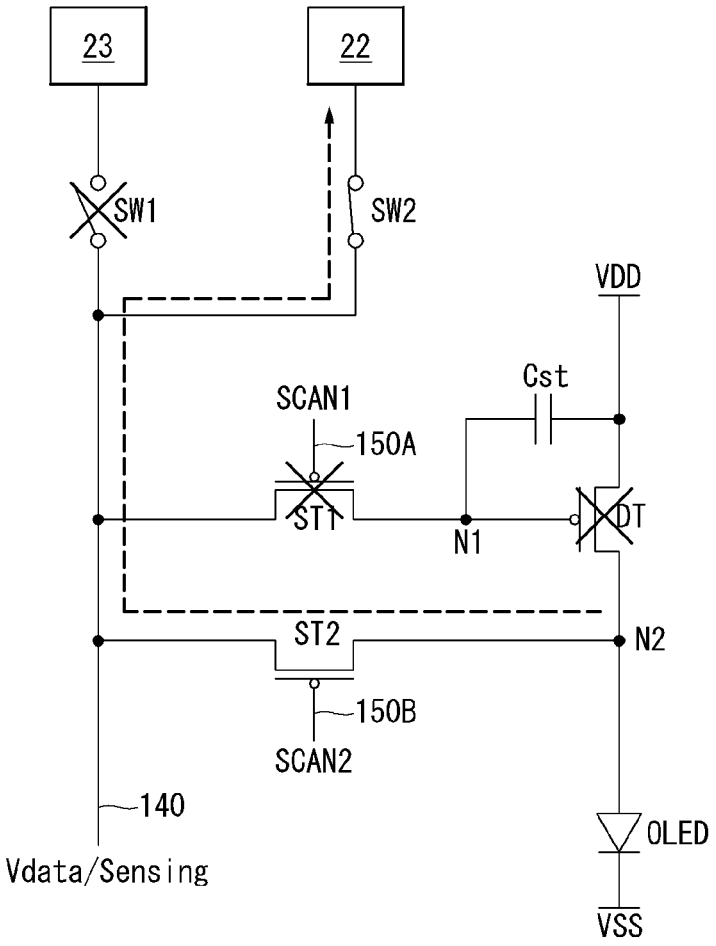
FIG. 12B is an equivalent circuit diagram of first and second switches and a pixel during a sensing period shown in FIG. 11.

FIG. 11 is a driving waveform diagram for sensing electrical characteristics of an electroluminescent display according to another example embodiment. FIG. 12A is an equivalent circuit diagram of first and second switches and a pixel during an initialization period shown in FIG. 11. FIG. 12B is an equivalent circuit diagram of first and second switches and a pixel during a sensing period shown in FIG. 11.

With reference to FIG. 11, a sensing drive operation according to another example embodiment may be implemented through an initialization period ①' and a sensing period a that are successively arranged. In FIG. 11, a data voltage Vdata is a sensing data voltage.

With reference to FIGS. 11 and 12A, during the initialization period ①', a second switch SW2 and a first switching TFT ST1 are turned off (OFF), and a first switch SW1 and a second switching TFT ST2 are turned on (ON). Thus, during the initialization period ①', the data voltage Vdata generated in a data voltage generator 23 is applied to a second node N2 through the first switch SW1 and the second switching TFT ST2. In the initialization period ①, the data voltage Vdata is set to be greater than an threshold voltage of an OLED so that a discharge is performed through the OLED. In the initialization period ①', the driving TFT DT satisfies turn-off condition, and an anode electrode of the OLED is initialized to the data voltage Vdata.

With reference to FIGS. 11 and 12B, during the sensing period ②, the first switch SW1 and the first switching TFT ST1 are turned off, and the second switch SW2 and the second switching TFT ST2 are turned on, a change in a voltage of the second node N2, which decreases as the data voltage Vdata is discharged through the OLED, through the data line 140 is read out. Thus, the data voltage Vdata that has been charged to the anode electrode of the OLED is discharged through the OLED during the sensing period ②', and as a result, a voltage of the second node N2 is gradually reduced. As the degradation of the OLED increases, a rate of a reduction in the voltage of the second node N2 decreases. This is because a current flowing through the OLED decreases due to an increase in a resistance component of the OLED as the degradation of the OLED proceeds. Because the second node N2 is connected to a data line 140 during the sensing period ②', a falling slope of a voltage of the data line 140 is less after the degradation of the OLED than before the degradation of the OLED during the sensing period ③'.

As described above, in another sensing drive operation according to the embodiment, it is possible to sense the degradation of the OLED even in a PMOS pixel structure. Furthermore, because the threshold voltage of the OLED is sensed through the data line instead of a sensing line of a sharing structure, the OLED can be directly sensed. In particular, in another sensing drive operation according to the embodiment, because characteristics of the OLED are sensed in a state of turning off the driving TFT DT, an electrical characteristic value of the driving TFT DT is not reflected in a sensing value of the characteristics of the OLED. As a result, embodiments can enhance the accuracy and reliability of sensing for the electrical characteristics of an OLED.

As described above, embodiments can sense the threshold voltage of the OLED without reducing the line design margin of the display panel by using the data lines for data supply in the sensing drive operation instead of the separate sensing line according to the related art.

It will be apparent to those skilled in the art that various modifications and variations can be made in the display device of the present disclosure without departing from the technical idea or scope of the disclosure. Thus, it is intended that the present disclosure cover the modifications and variations of this disclosure provided they come within the scope of the appended claims and their equivalents.

What is claimed is:

1. An electroluminescent display comprising:

a display panel including a plurality of pixels, a plurality of gate lines, and a plurality of data lines; and a driver integrated circuit connected to the data line through a channel terminal, wherein the driver integrated circuit includes:

a data voltage generator configured to generate a data voltage to be supplied to the pixel;

a first switch connected between the channel terminal and the data voltage generator;

a sensor configured to sense electrical characteristics of the pixel; and a second switch connected between the channel terminal and the sensor, wherein each pixel includes:

a driving thin film transistor (TFT) including a control electrode connected to a first node, a first electrode connected to a high potential driving power, and a second electrode connected to a second node;

an organic light emitting diode (OLED) connected between the second node and a low potential driving power;

a first switching TFT including a control electrode connected to a first gate line supplied with a first gate signal, a first electrode connected to the data line, and a second electrode connected to the first node;

a second switching TFT including a control electrode connected to a second gate line supplied with a second gate signal, a first electrode connected to the data line, and a second electrode connected to the second node; and a storage capacitor connected between the high potential driving power and the first node, wherein during a degradation tracking period following a first programming period, the first and second switches are turned off, and the first and second switching TFTs are turned on.

2. The electroluminescent display of claim 1, wherein during the first programming period, the first switch, the first switching TFT, and the second switching TFT are turned on, and the second switch is turned off, wherein during a second programming period following the degradation tracking period, the first switch and the second switching TFT are turned on, and the second switch and the first switching TFT are turned off, and wherein during a sensing period following the second programming period, the second switch and the second switching TFT are turned on, and the first switch and the first switching TFT are turned off.

3. The electroluminescent display of claim 2, wherein the data voltage generator supplies a first data voltage to the data line during the first programming period and the degradation tracking period, and supplies a second data voltage higher than the first data voltage to the data line during the second programming period.

4. The electroluminescent display of claim 3, wherein a difference between a voltage of the high potential driving power and the first data voltage is greater than a threshold voltage of the driving TFT.

5. The electroluminescent display of claim 4, wherein a voltage of the data line increases in proportional to a degradation of the OLED during the degradation tracking period, and wherein during the sensing period, a rising slope of the voltage of the data line is less after the degradation of the OLED than before the degradation of the OLED.

6. The electroluminescent display of claim 1, wherein the driving TFT, the first switching TFT, and the second switching TFT are implemented as p-type metal-oxide semiconductor (PMOS) transistors.

7. A method of sensing electrical characteristics of an electroluminescent display including a driver integrated circuit having a first switch and a second switch, and a plurality of pixels each including a driving thin film transistor (TFT) including a control electrode connected to a first node, a first electrode connected to a high potential driving power, and a second electrode connected to a second node, an organic light emitting diode (OLED) connected between the second node and a low potential driving power, a first switching TFT including a control electrode connected to a first gate line supplied with a first gate signal, a first electrode connected to a data line, and a second electrode connected to the first node, a second switching TFT including a control electrode connected to a second gate line supplied with a second gate signal, a first electrode connected to the data line, and a second electrode connected to the second node, and a storage capacitor connected between the high potential driving power and the first node, the method comprising:

during a first programming period, applying a first data voltage to the first node and the second node through a data line to turn on the driving TFT;

during a degradation tracking period following the first programming period, applying a driving current to the OLED from the driving TFT to set a voltage of the second node depending on a degradation of the OLED;

during a second programming period following the degradation tracking period, applying a second data voltage higher than the first data voltage to the second node through the data line; and during a sensing period following the second programming period, reading out a change in the voltage of the second node, which decreases depending on the driving current, through the data line, wherein during the degradation tracking period, the first and second switches are turned off, and the first and second switching TFTs are turned on.

8. The method of claim 7, wherein a voltage of the data line connected to the second node increases in proportional to the degradation of the OLED during the degradation tracking period, and wherein during the sensing period, a rising slope of the voltage of the data line connected to the second node is less after the degradation of the OLED than before the degradation of the OLED.

9. A method of sensing electrical characteristics of an electroluminescent display including a driver integrated circuit having a first switch and a second switch, and a plurality of pixels each including a driving thin film transistor (TFT) including a control electrode connected to a first node, a first electrode connected to a high potential driving power, and a second electrode connected to a second node, and an organic light emitting diode (OLED) connected between the second node and a low potential driving power, a first switching TFT including a control electrode connected to a first gate line supplied with a first gate signal, a first electrode connected to a data line, and a second electrode connected to the first node, a second switching TFT including a control electrode connected to a second gate line supplied with a second gate signal, a first electrode connected to the data line, and a second electrode connected to the second node, and a storage capacitor connected between the high potential driving power and the first node, the method comprising:

during an initialization period, applying a data voltage higher than a threshold voltage of the OLED to the second node through the data line to initialize the second node by turning on the first switch and the second switching TFT and turning off the second switch and the first switching TFT; and during a sensing period following the initialization period, reading out a change in a voltage of the second node, which decreases as the data voltage is discharged through the OLED, through the data line by turning on the second switch and the second switching TFT and turning off the first switch and the first switching TFT.

10. The method of claim 9, wherein during the sensing period, a falling slope of a voltage of the data line connected to the second node is less after a degradation of the OLED than before the degradation of the OLED.

* * * * *